US008082625B2

(12) United States Patent
Vanderlinden

(10) Patent No.: US 8,082,625 B2
(45) Date of Patent: Dec. 27, 2011

(54) PICK-UP HEAD HAVING HOUSED GUTTER BROOMS FOR A MOBILE SWEEPING VEHICLE

(76) Inventor: Roger P. Vanderlinden, Burlington (CA)

( * ) Notice: Subject to any disclaimer, the term of this patent is extended or adjusted under 35 U.S.C. 154(b) by 42 days.

(21) Appl. No.: 12/238,387

(22) Filed: Sep. 25, 2008

(65) Prior Publication Data

US 2009/0090385 A1 Apr. 9, 2009

Related U.S. Application Data

(60) Provisional application No. 60/975,079, filed on Sep. 25, 2007.

(51) Int. Cl.
*E01H 1/08* (2006.01)

(52) U.S. Cl. ..... 15/416; 15/419; 15/420; 15/340.1; 15/340.3; 15/340.4; 15/383; 15/384; 15/385

(58) Field of Classification Search ..... 15/340.1, 15/340.3, 340.4, 50.1, 383–385, 416, 419, 15/420; *E01H 1/08*
See application file for complete search history.

(56) References Cited

U.S. PATENT DOCUMENTS

| | | | | |
|---|---|---|---|---|
| 3,186,021 | A * | 6/1965 | Krier et al. | 15/340.4 |
| 3,409,933 | A * | 11/1968 | Larsson | 15/364 |
| 3,436,788 | A * | 4/1969 | Tamny | 15/385 |
| 6,584,640 | B2 * | 7/2003 | Vanderlinden | 15/418 |
| 6,966,097 | B2 * | 11/2005 | Engel et al. | 15/348 |

* cited by examiner

*Primary Examiner* — David Redding

(57) ABSTRACT

A pick-up head for a mobile sweeping vehicle comprises a housing defining a substantially hollow interior and a suctioning bottom opening for suctioning dust and small debris. A suctioning front opening is disposed in the front of the housing for receiving debris into the substantially hollow interior of the housing. A door is mounted on the pick-up head for selectively opening and closing the suctioning front opening. A dust and debris outlet in the housing permits dust and debris to be suctioned from the substantially hollow interior. A gutter broom is mounted within the housing adjacent one end, for sweeping dust and small debris inwardly from the selected one of the left end and the right end and towards the dust and debris outlet. An opening in the housing at the selected end permits the gutter broom to extend beyond the end of the housing, thus allowing the gutter broom to sweep against a curb, for sweeping dust and small debris towards a central path. A selectively operable motor is for operating the first gutter broom.

14 Claims, 5 Drawing Sheets

PICK-UP HEAD HAVING HOUSED GUTTER BROOMS FOR A MOBILE SWEEPING VEHICLE

This application is a non-provisional application claiming priority from U.S. Provisional Patent Application Ser. No. 60/975,079 filed on Sep. 25, 2007, which is herein incorporated by reference.

FIELD OF THE INVENTION

The present invention relates to factory and sidewalk sweepers, and more particularly to pick-up heads for factory and sidewalk sweepers.

BACKGROUND OF THE INVENTION

Sidewalk sweepers and factory floor sweepers of various types are used to sweep debris in many different types of locations. Sidewalk sweepers are typically used to sweep sidewalks, parking lots, and so on, and must sweep along curbs and the sides of buildings in order to sweep dust and debris that is adjacent to the curbs and buildings. Factory floor sweepers are typically used to sweep aisle ways in factories and warehouses, and the like.

In each case, the sidewalk sweepers or factory sweepers typically have two gutter brooms each mounted on at laterally movable arm assembly directly in front of the sweeping vehicle. Typically, the gutter brooms are each about three feet in diameter. Together, the two gutter brooms sweep a path that is wider than the sweeper. Further, since the two gutter brooms are each mounted on a laterally movable arm assembly, the width of the path that can be swept verities from perhaps a bit under six feet to a little over seven feet.

In order to keep a selected one of the left and right gutter brooms against a curb, wall, or the like, the sweeper is steered as accurately possible by the operator. Further, the gutter broom adjacent to the curb, wall or the like, is operated so as to move the gutter broom laterally in and out.

The left and right gutter brooms are counter-rotating such that the left gutter broom rotates clockwise and the right gutter broom rotates counterclockwise. In this manner, each of the left and right gutter brooms move debris forwardly at the outer edge of the swept path, and moves debris laterally over to the center of the sweeper, and then somewhat rearwardly towards a pickup head. Conventional pickup heads are typically about two feet in width, and are disposed perhaps about one foot behind the left and right gutter brooms, generally under the cab of the sweeper.

There are a number of significant problems associated with conventional prior art sidewalk sweepers and factory floor sweepers. The most significant problem is that a substantial amount of airborne dust is created by the gutter brooms during the sweeping operation. The airborne dust travels freely in the ambient air and remains airborne for a lengthy period of time and can travel for a considerable distance. Eventually, the dust settles on various surfaces, including the road that was swept, where it usually becomes disturbed by passing cars, to thereby become airborne again.

It is widely accepted in the industry that the containment of dust generated during the sweeping operation of the gutter brooms by a sidewalk sweeper or a factory floor sweeper is extremely difficult, especially the containment of dust having a particle size under ten microns, without using water.

Recently, it has become increasingly important for environmental reasons to not just fully remove dirt and debris during a street cleaning operation, but to remove dust and other particulate matter, especially particles less than about ten microns. In many jurisdictions, there are strict environmental laws pertaining to the removal and containment, during a street cleaning operation, of particulate matter having a size of less than ten microns, which is essentially breathable particulate.

Due to their overall fundamental design with the gutter brooms disposed exteriorly to the pickup head, conventional sidewalk sweepers and factory floor sweepers cannot contain fine particulate matter that has become airborne, without the use of water for dust suppression; however, the use of water for dust suppression is highly undesirable as it creates at least two problems. A covering of wet dirt, or essentially muck, remains on the surface behind the surface sweeping vehicle, which is unacceptable. Further, during warm weather, when the water in this wet dirt evaporates, significant amounts of dried small particulate matter from the wet dirt become air borne, which is also unacceptable and even in contravention of by-laws in some jurisdictions. Also, water cannot be used outdoors in cold winter weather because the water tends to freeze on the surface being cleaned, thus creating unsafe conditions. Also, the water and tends to freeze in tank, lines and water pipes of the sweeper.

It is known in prior art sidewalk sweepers and factory floor sweepers to separately shroud the gutter brooms in order to contain this dust. The dust is suctioned away from the gutter broom by the air suctioning or air recirculating system that is used in conjunction with a main sweeping broom for capturing dust and debris, and is delivered to the filter system of the sweeper.

Unfortunately, such shrouding creates two significant problems. The first problem relates directly to the purpose of the sidewalk sweeper or factory floor sweeper. The shroud generally precludes all but very small debris from reaching the gutter broom, which is unacceptable. Accordingly, it is known to open a portion of the shroud around the gutter broom in order to permit debris to be received by the gutter broom. While this sounds like a simple solution, it actually creates the second significant problem. The creation of an opening in the shroud around the gutter brooms causes a significant amount of the airflow to be diverted from the air suctioning or air recirculating system, thereby significantly decreasing the amount of airflow available used in conjunction with a main sweeping broom for capturing dust and debris. Accordingly, the capacity of the air suctioning or air recirculating system is significantly decreased, typically to a generally unacceptable level.

Further, the second main overall problem associated with conventional prior art sidewalk sweepers and factory floor sweepers is that of the path of dust and debris that is created by the left and right gutter brooms. Dust and debris on the surface is often missed by the pick-up head. As the sweeper turns, especially if it turns sharply, dust and debris are often left on the surface being cleaned in a path between the outer gutter broom (as compared to the direction being turned) and the pick-up head.

It is an object of the present invention to provide a pick-up head for use with a sidewalk sweeper and a factory floor sweeper.

It is another object of the present invention to provide a pick-up head for use with a sidewalk sweeper and a factory floor sweeper, wherein there is virtually no air borne dust that escapes into the ambient surroundings during use by the gutter brooms of the sweeper.

It is a further object of the present invention to provide a pick-up head for use with a sidewalk sweeper and a factory floor sweeper, wherein there is virtually no particulate matter that escapes into the ambient surroundings during use by the gutter brooms of the sweeper.

It is a further object of the present invention to provide a pick-up head for use with a sidewalk sweeper and a factory floor sweeper, wherein there is virtually no particulate matter having a size of less than 10 microns created in use by the gutter brooms of the sweeper.

It is another object of the present invention to provide a pick-up head for use with a sidewalk sweeper and a factory floor sweeper, wherein there is virtually no air borne dust and particulate matter that escapes into the ambient surroundings during use by the gutter brooms of the sweeper, wherein small debris is readily received by the gutter brooms.

It is another object of the present invention to provide a pick-up head for use with a sidewalk sweeper and a factory floor sweeper, wherein there is virtually no air borne dust and particulate matter that escapes into the ambient surroundings during use by the gutter brooms of the sweeper, while still permitting the air suctioning or air recirculating system to function at its required capacity.

It is a further object of the present invention to provide a pick-up head for use with a sidewalk sweeper and a factory floor sweeper, wherein said sweeper does not use water for dust suppression.

It is a further object of the present invention to provide a pick-up head for use with a sidewalk sweeper and a factory floor sweeper, wherein the path of dust and debris that is created by the gutter brooms is always picked up by the pick up head.

SUMMARY OF THE INVENTION

In accordance with one aspect of the present invention there is disclosed a novel pick-up head for a mobile sweeping vehicle. The pick-up head comprises a housing defining a substantially hollow interior and having a front, a back, a left end and a right end, a top and a bottom. The housing also has a suctioning bottom opening for suctioning dust and small debris into the substantially hollow interior of the housing. A dust and debris outlet in the housing permits dust and debris to be suctioned from the substantially hollow interior of the housing. A first gutter broom is mounted within the housing adjacent a selected one of the left end and the right end, for sweeping dust and small debris away from the selected one of said left and right end and towards said dust and debris outlet. A selectively operable motor means rotates the first gutter broom.

In accordance with another aspect of the present invention there is disclosed a novel pick-up head for a mobile sweeping vehicle. The pick-up head comprises a housing defining a substantially hollow interior and a suctioning bottom opening for suctioning dust and small debris into the substantially hollow interior of the housing. In seriatim, there is a first gutter broom opening in the housing, a first gutter broom having a selectively operable motor means, the substantially hollow interior of the housing, and a dust and debris outlet in the housing for permitting dust and debris to be suctioned from the substantially hollow interior of the housing into a hopper.

In accordance with another aspect of the present invention there is disclosed a novel method of picking up debris using a pick-up head on a mobile sweeping vehicle. The method comprising the steps of suctioning air such that it passes through, in seriatim, a first gutter broom opening in a housing of the pickup head, a first gutter broom, the substantially hollow interior of the housing, and a dust and debris outlet in the housing for permitting dust and debris to be suctioned from the substantially hollow interior of the housing into a hopper.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described herein below.

BRIEF DESCRIPTION OF THE DRAWINGS

The novel features which are believed to be characteristic of the pick-up head for a mobile sweeping vehicle according to the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF THE PREFERRED EMBODIMENTS

Figure 1:
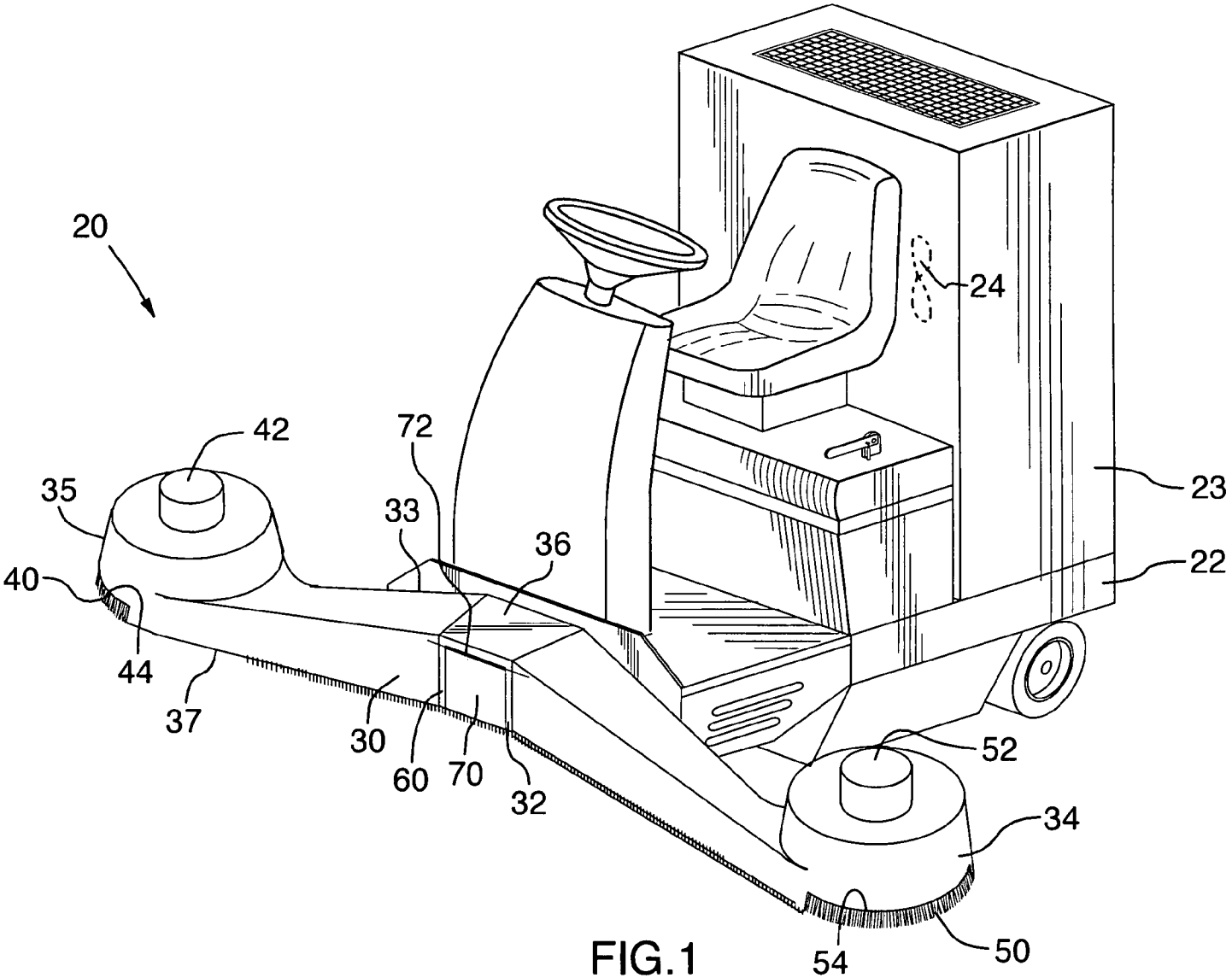
FIG. 1 is a perspective view of the preferred embodiment of the pick-up head according to the present invention, in use on a mobile sweeping vehicle.
Figure 2:
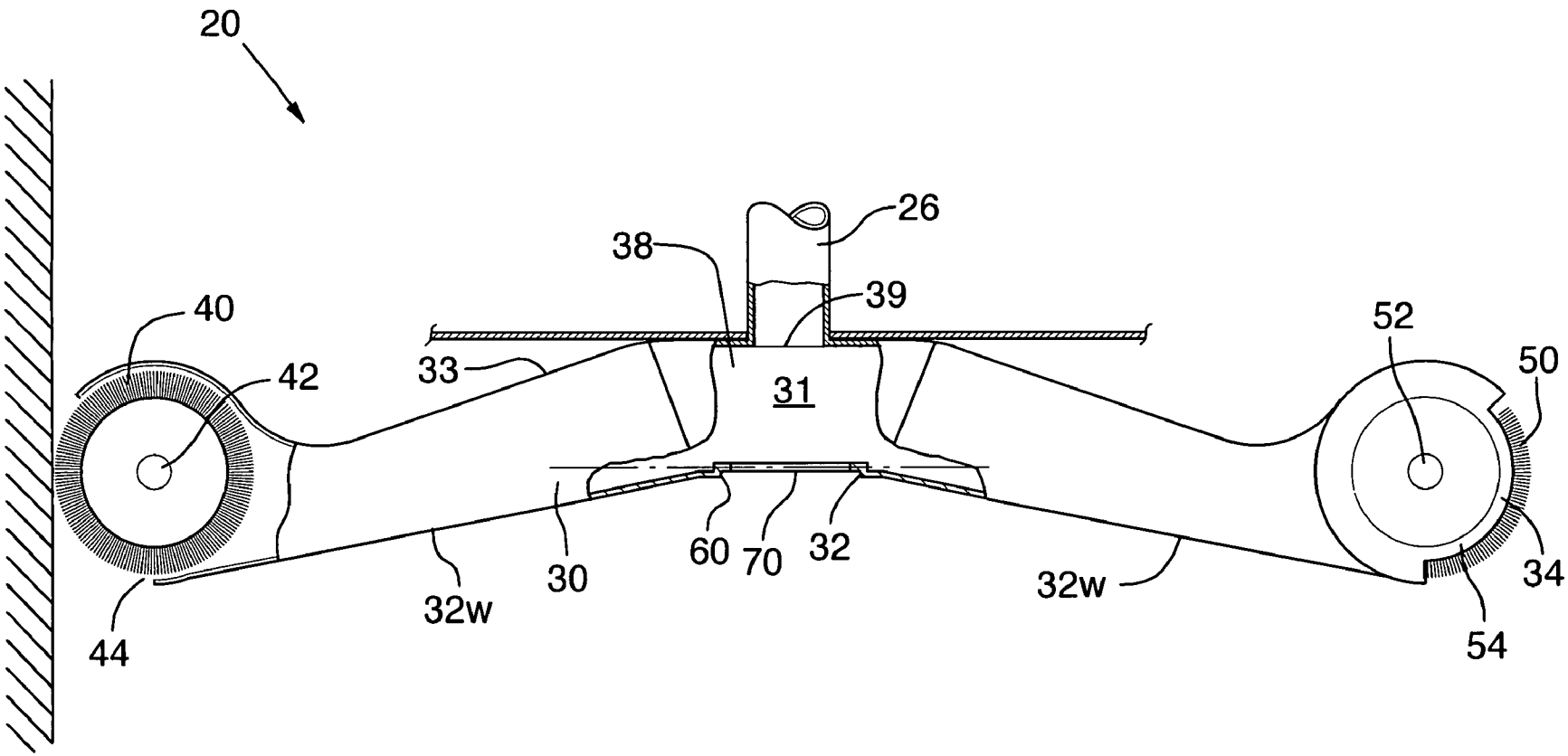
FIG. 2 is a top plan view of the preferred embodiment pick-up head of FIG. 1; and, FIG. 3 is a front elevational view of the preferred embodiment pick-up head of FIG. 1.
Figure 3:
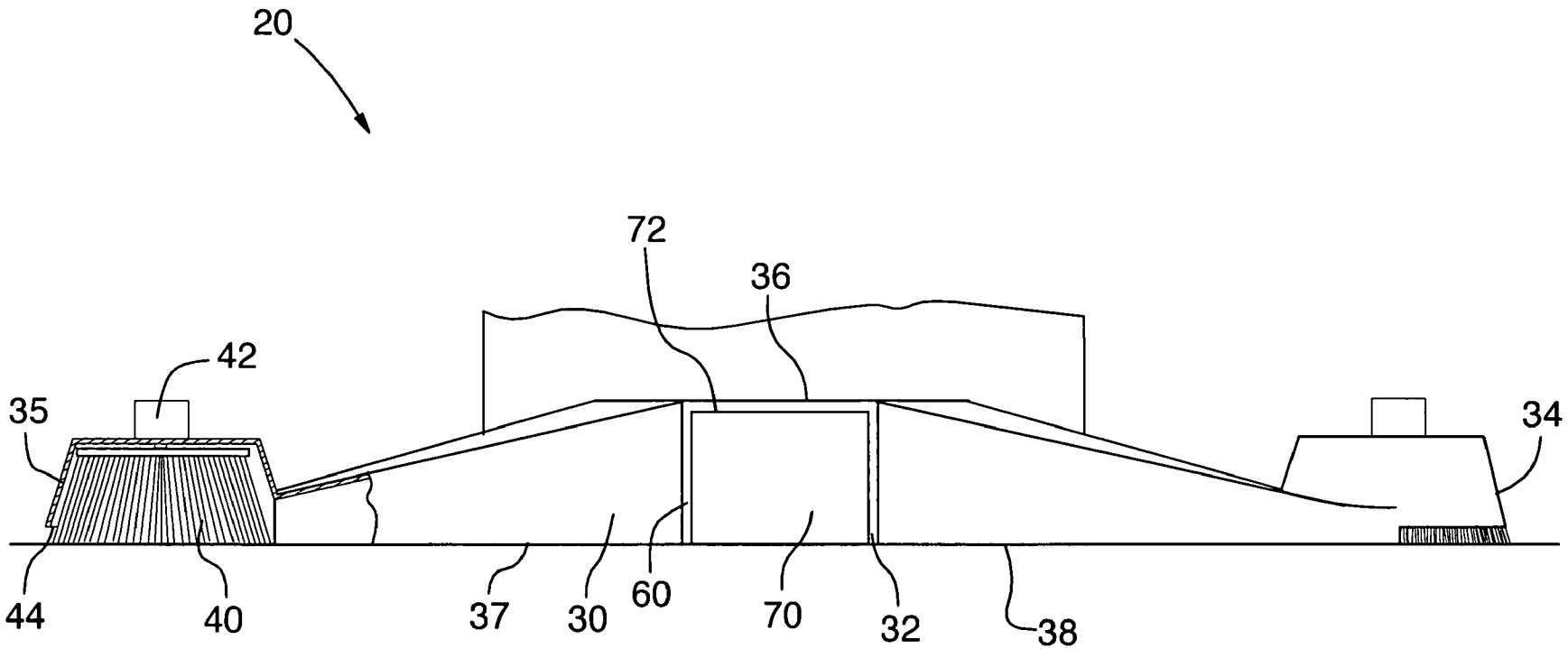
Figure 4:
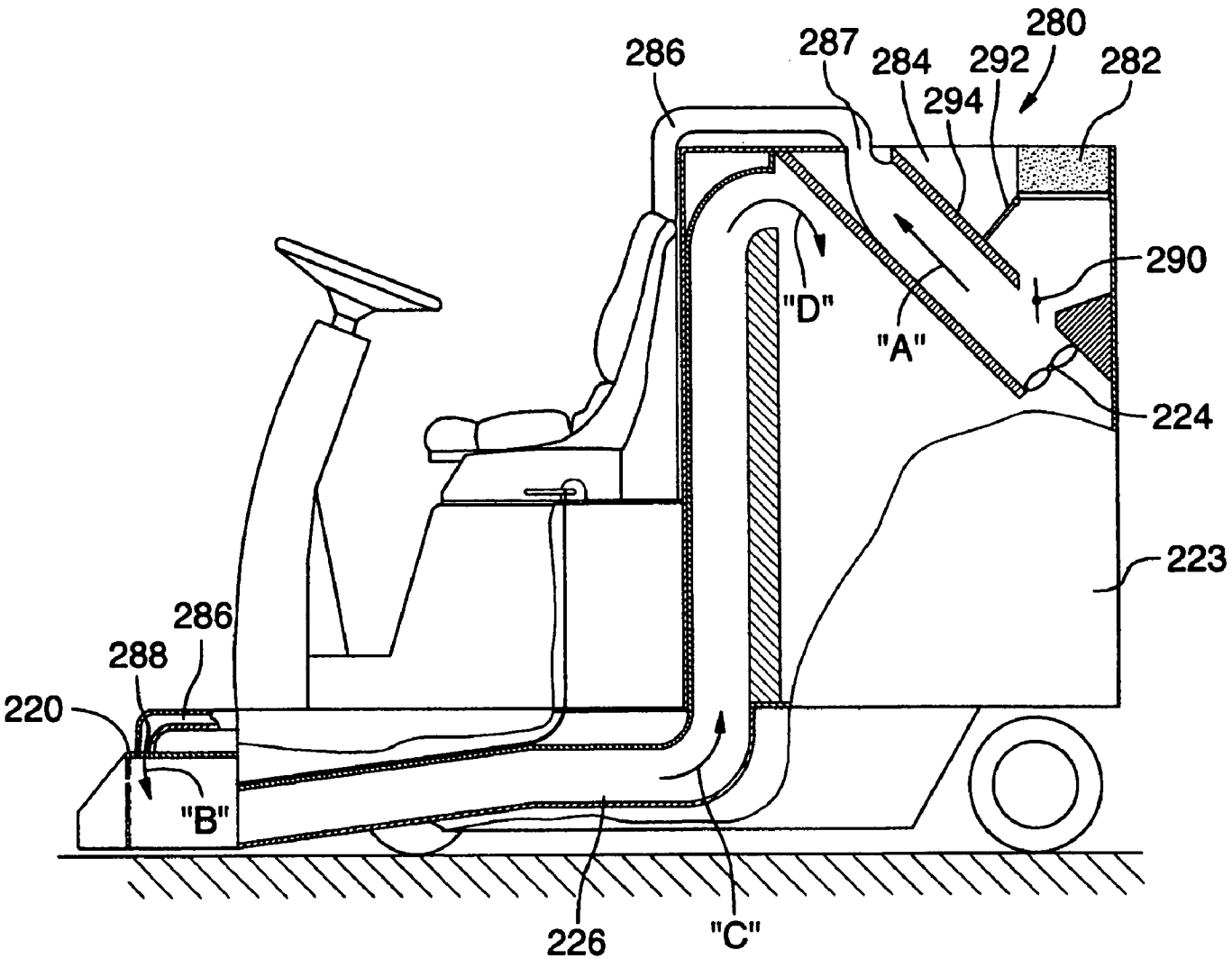
FIG. 4 is a partially cut-away side elevational view of the second preferred embodiment pick-up head according to the present invention, in use on a mobile sweeper vehicle; and, FIG. 5 is a perspective view of a portion of the second preferred embodiment pick-up head of FIG. 4.
Figure 5:
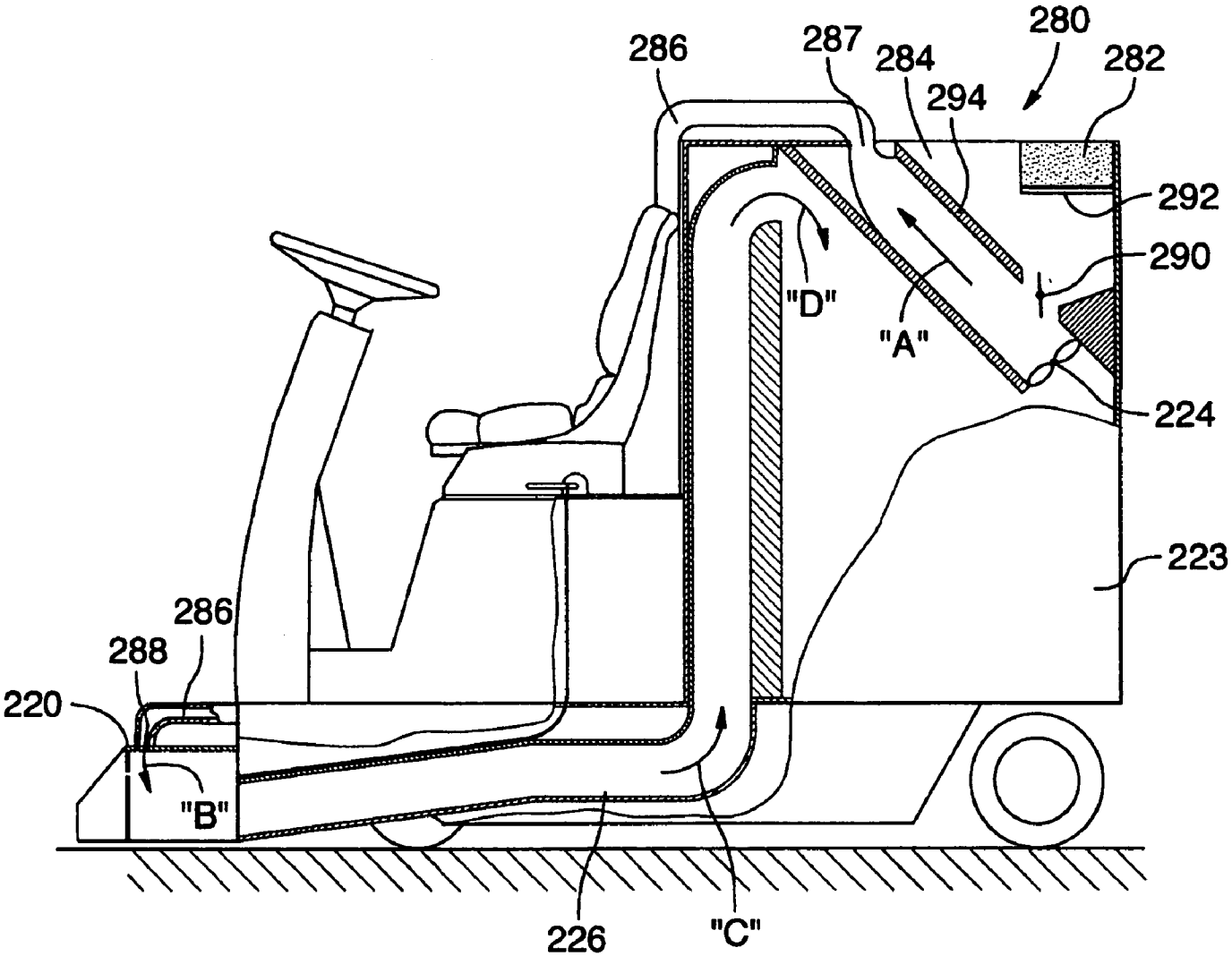

Referring to FIGS. 1 through 5 of the drawings, it will be noted that FIGS. 1 through 3 illustrate a first preferred embodiment of the variable width pick-up head of the present invention, and FIGS. 4 and 5 illustrate a second preferred embodiment of the variable width pick-up head of the present invention.

Reference will now be made to FIGS. 1 through 3, which show a preferred embodiment of the pick-up head for a mobile sweeping vehicle 22 according to the present invention, as indicated by general reference numeral 20. The pick-up head 20 for a mobile sweeping vehicle 22 comprises a housing 30 defining a substantially hollow interior 31 and having a front 32, a back 33, a left end 34 and a right end 35, a top 36 and a bottom 37. There is a suctioning bottom opening 38 for suctioning dust and small debris, such as dirt and small stones, and the like, into the substantially hollow interior 31 of the housing 30. There is a dust and debris outlet 39 in the housing 30 for permitting dust and debris to be suctioned from the substantially hollow interior 31 of the housing 30 into a hopper 23 that is mounted at the back of the mobile sweeping vehicle 22, via a duct 26. The dust and debris outlet 39 is preferably disposed in the back 33 of the housing 30, so as to take advantage of the relative travel of debris with respect to the pick-up head 20 as the mobile sweeping vehicle 22 travels forwardly.

A first gutter broom 40 is mounted within the housing 30 adjacent a selected one of the left end and the right end, for sweeping dust and small debris inwardly away from the selected one of the left end and the right end and towards the dust and debris outlet 39. In the preferred embodiment, as illustrated, the first gutter broom 40 is mounted within the housing 30 adjacent the right end 35 of the housing 30. Accordingly, the first gutter broom 40 is a right gutter broom.

There is a selectively actuatable motor means, which preferably comprises a first hydraulic motor 42 mounted on top of the first gutter broom 40, for rotating the first gutter broom 40. The rotation of the first hydraulic motor 42 is controlled by the operator of the mobile sweeping vehicle 22, via a suitable manually operable control.

As can be readily seen in the figures, the pick-up head 20 further comprises a first gutter broom opening 44 in the housing 30 at the selected one of the left end and the right end, for accessing debris therethrough. The first gutter broom 40 is disposed at the first gutter broom opening 44, to thereby extend partially beyond the selected one of the left end and the right end, thus allowing the first gutter broom 40 to sweep against a generally vertically disposed surface, such as a curb. The first gutter broom opening 44 extends inwardly, at the front of the housing 30, away from the selected one of the left end and the right end of the housing 30, to permit the first gutter broom 40 to receive higher accumulations and larger sizes of debris. Preferably, the first gutter broom opening 44 is about two centimeters in height, to permit small mounds of dirt and small debris, such as stones and the like, to egress into the substantially hollow interior 31 of the housing 30.

The pick-up head 20 further comprising a second gutter broom 50 mounted within the housing 30 adjacent the end of the housing 30 opposite to the selected end of the housing 30, for sweeping dust and small debris inwardly away from the end of the housing 30 opposite to the selected end of the housing 30 and towards the dust and debris outlet 39. In the preferred embodiment, as illustrated, the second gutter broom 50 is mounted within the housing 30 adjacent the left end 34 of the housing 30. Accordingly, the second gutter broom 50 is a left gutter broom.

There is a selectively actuatable motor means, which preferably comprises a second hydraulic motor 52 mounted on top of the second gutter broom 50, for rotating the second gutter broom 50. The rotation of the second hydraulic motor 52 is controlled by the operator of the mobile sweeping vehicle 22, via a suitable manually operable control.

As can be readily seen in the figures, the pick-up head 20 further comprises a second gutter broom opening 54 in the housing 30 at the end of the housing 30 opposite to the selected end of the housing 30, for accessing debris therethrough. The second gutter broom 50 is disposed at the second gutter broom opening 54, to thereby extend partially beyond the end of the housing 30 opposite to the selected end of the housing 30, thus allowing the second gutter broom 50 to sweep against a generally vertically disposed surface, such as a curb. The second gutter broom opening 54 extends inwardly, at the front of the housing 30, away from the end of the housing 30 opposite to the selected end of the housing 30, to permit the second gutter broom 50 to receive higher accumulations and larger sizes of debris. Preferably, the second gutter broom opening 54 is about two centimeters in height, to permit small mounds of dirt and small debris, such as stones and the like, to egress into the substantially hollow interior 31 of the housing 30.

The pick-up head 20 further comprises a suctioning front opening 60 disposed in the front of the housing 30 for receiving debris into the substantially hollow interior 31 of the housing 30, and in debris receiving relation with respect to a surface being cleaned. Preferably, the suctioning front opening 60 is disposed generally centrally in the front of the housing 30. It will also be noted that the dust and debris outlet 39 is generally centrally disposed in the back of the housing 30, so as to be generally laterally aligned with the suctioning front opening 60. The suctioning front opening 60 needs to be large enough to accept large debris, such as most sizes of cans and bottles therethrough.

A selectively openable and closable door means 70 is operatively mounted on the pick-up head 20, at the suctioning front opening 60, for selectively opening and closing the suctioning front opening 60. The openable and closeable door means 70 comprises at least one door member mounted in hinged relation on the housing 30. In the preferred embodiment, as illustrated, the openable and closeable door means 70 comprises a single door 70 mounted by means of a horizontally oriented top hinge 72. Preferably, the at least one door member 70 is mounted so as to open inwardly into the substantially hollow interior 31 of the housing 30. In this manner, the door member 70 opens in the same direction as the relative travel of debris with respect to the pick-up head 20 as the mobile sweeping vehicle 22 travels forwardly.

The pick-up head 20 further comprises means for urging large debris towards the suctioning front opening 60. In the preferred embodiment, as illustrated, the means for urging debris towards the suctioning front opening 60 comprises a "V"-shaped front wall portion 32*w* of the housing 30. The suctioning front opening 60 is disposed at the vertex of the "V"-shaped front wall portion 32*w*, so as to receive large debris that is pushed along the left and right front walls of the housing 30, as the mobile sweeping vehicle 22 travels forwardly.

In another aspect of the present invention, as can be readily seen in the figures, the pick-up head 20 comprises a housing 30 defining a substantially hollow interior 31 and a suctioning bottom opening 38 for suctioning dust and small debris into the substantially hollow interior 31 of the housing 30. The invention further comprises, in seriatim, the first gutter broom opening 44 in the housing 30, the first gutter broom 40 having a selectively actuatable motor means 42, the substantially hollow interior 31 of the housing 30, and the dust and debris outlet 39 in the housing 30 for permitting dust and debris to be suctioned from the substantially hollow interior 31 of the housing 30 into a hopper 23. The serial arrangement of the first gutter broom opening 44, the first gutter broom 40, the substantially hollow interior 31 and the dust and debris outlet 39 permit the capturing and suctioning of dust that is caused to be airborne by the left and right gutter brooms 40, 50.

The present invention also provides a method of picking up debris using a pick-up head 20 on a mobile sweeping vehicle. The method comprising the steps of suctioning air such that it passes through, in seriatim, a first gutter broom opening 44 in a housing 30 of the pickup head 20, a first gutter broom 40, the substantially hollow interior 31 of the housing 30, and a dust and debris outlet 39 in the housing 30 for permitting dust and debris to be suctioned from the substantially hollow interior 31 of the housing 30 into a hopper.

In use, as the mobile sweeping vehicle 22 travels forwardly, dust and debris on the surface being cleaned are encountered by the pick-up head 20. Dust and small debris near or against a generally vertically disposed surface, such as a curb, are encountered by the one of the left and right gutter brooms 40, 50. For the sake of ease of reference, the right gutter broom 40 will be referred to, but the same explanation also applies to the left gutter broom 50. The dust and small debris encountered by the right gutter broom 40 are swept inwardly away from the left end 34 of the housing 30. Most of the small debris is swept such that it remains within the housing 30. A lesser portion of the small debris is swept inwardly and also slightly forwardly of the housing 30. This small debris is either re-encountered by the right gutter broom 40 or is encountered by the left and right front walls 32*w* of housing 30. Further, large debris is also encountered by the left and right front walls 32*w* of housing 30. The debris that is encountered by the left and right front walls of housing 30 will be moved to the suctioning front opening 60, due to slope of the "V"-shaped front wall portion 32*w* of the housing 30. Dust that is created by the right gutter broom 40 is suctioned into the housing 30, through the duct 26, and into the hopper 23, by a source of suction, such as a fan 24.

As can readily be seen, the pick-up head 20 according to the present invention, uses its gutter brooms to sweep dust and debris from the area near or against a generally vertically disposed surface, such as a curb, and also suctions the air borne dust created in use by the gutter brooms of the sweeper, so that there is no dust created by the gutter brooms during use.

It should also be noted that the pick-up head 20 for a mobile sweeping vehicle 22 according to the present invention can be used as part of a vacuum type system on a sidewalk sweeper or a factory floor sweeper, or as part of a re-circulating type system on a sidewalk sweeper or a factory floor sweeper, as will now be discussed.

Reference will now be made to FIGS. 4 and 5, which show a second preferred embodiment of the pick-up head according to the present invention, as indicated by reference numeral 220. The second preferred embodiment pick-up head 220 is similar to the first preferred embodiment pick-up head 20, except that it is used in a re-circulating type system on a sidewalk sweeper or a factory floor sweeper. As can be readily seen in FIGS. 4 and 5, the top covering 280 of the hopper 223 has a built in panel filter 282 at the back, and unfiltered direct opening 284 to the ambient surroundings adjacent the panel filter 282. A recirculating air hose 286 has its inlet 287 at the top covering 280 of the hopper 223 and its outlet 288 in the pickup head to form a "closed loop" system with the fan 224. The fan 224 blows unfiltered air into the inlet 287 of the recirculating air hose 286, as indicated by arrow "A". This air is introduced into the pick-up head 220, as indicated by arrow "B", in order to help capture dust and debris within the pick-up head 220. The recirculating air, including the dust and debris, circulate through the duct 226, as indicated by arrow "C", and returned to the hopper 223, as indicated by arrow "D", as drawn in by the fan 224.

A portion of the air from the fan 224 is bled off to the atmosphere, as controlled by flap valve 290, either through the panel filter 282, as is shown in FIG. 4, or through the direct opening 284, as is shown in FIG. 5. A large gate valve 292 is mounted in hinged relation at the junction between the panel filter 282 and a direct opening 284 for movement between a first position, as shown in FIG. 4, whereat all of the air flow that is bled off is directed through the panel filter 282. The large gate valve 292 seals against the slanted wall 294 in order to preclude air from escaping through the direct opening 284. This mode is used during dry sweeping in order to preclude dust from escaping to the atmosphere. There were circulation of a substantial portion of the airflow significantly reduces the volume of air that must be filtered per unit time, which is a significant problem with vacuum type sweepers.

In the event that sweeping must be performed in wet or damp conditions, there is no actual dust generated that needs to be controlled and captured; however, there is a wet airborne particulate that must be dealt with. It is well known that this wet airborne particulate can readily clog a panel filter 282. Accordingly, the large gate valve 292 can be moved to the position as shown in FIG. 5, whereat the panel filter 282 is covered, and there is a direct path for the flow of air that is bled off to the direct opening 284 to the ambient surroundings, thus precluding the panel filter 282 from becoming clogged.

As can be understood from the above description and from the accompanying drawings, the present invention provides a pick-up head for use with a sidewalk sweeper and a factory floor sweeper, wherein there is virtually no air borne dust created in use by the gutter brooms of the sweeper, wherein there is virtually no particulate matter created in use by the gutter brooms of the sweeper, wherein there is virtually no particulate matter having a size of less than 10 microns created in use by the gutter brooms of the sweeper, wherein small debris is readily received by the gutter brooms, wherein there is virtually no air borne dust and particulate matter that escapes into the ambient surroundings during use by the gutter brooms of the sweeper while still permitting the air suctioning or air recirculating system to function at its required capacity, wherein said sweeper does not use water for dust suppression, and wherein the path of dust and debris that is created by the gutter brooms is always picked up by the pick up head, all of which features are unknown in the prior art.

Other variations of the above principles will be apparent to those who are knowledgeable in the field of the invention, and such variations are considered to be within the scope of the present invention. Further, other modifications and alterations may be used in the design and manufacture of the pick-up head for a mobile sweeping vehicle of the present invention without departing from the spirit and scope of the accompanying claims.

I claim:

1. A pick-up head for a mobile sweeping vehicle, said pick-up head comprising:

a housing defining a substantially hollow interior and having a front, a back, a left end and a right end, a top and a bottom, and a suctioning bottom opening for suctioning dust and small debris into said substantially hollow interior of said housing;

a dust and debris outlet in said housing for permitting dust and debris to be suctioned from said substantially hollow interior of said housing into a hopper;

a first gutter broom mounted within said housing adjacent a selected one of said left end and said right end, for sweeping dust and small debris inwardly away from said selected one of said left end and said right end and towards said dust and debris outlet;

selectively operable motor means for rotating said first gutter broom, a first gutter broom opening in said housing at said selected one of said left end and said right end, for accessing debris therethrough;

wherein said first gutter broom is disposed at said first gutter broom opening, to thereby extend partially beyond said selected one of said left end and said right end, thus allowing said first gutter broom to sweep against a generally vertically disposed surface; and, wherein said first gutter broom opening extends inwardly, at the front of said housing, away from the selected one of said left end and said right end of said housing, to permit said first gutter broom to receive higher accumulations and larger sizes of debris.

2. The pick-up head of claim 1, further comprising a second gutter broom mounted within said housing adjacent the end of said housing opposite to said selected end of said housing, for sweeping dust and small debris inwardly away from the end of said housing opposite to said selected end of said housing, and selectively operable motor means for operating said second gutter broom.

3. The pick-up head of claim 2, further comprising a second gutter broom opening in said housing at the end of said housing opposite to said selected end of said housing, for accessing debris therethrough.

4. The pick-up head of claim 3, wherein said second gutter broom is disposed at said second gutter broom opening, to thereby extend partially beyond the end of said housing opposite to said selected end of said housing, thus allowing said second gutter broom to sweep against a generally vertically disposed surface.

5. The pick-up head of claim 4, wherein said second gutter broom opening extends inwardly, at the front of said housing, away from the end of said housing opposite to said selected end of said housing, to permit said second gutter broom to receive higher accumulations and larger sizes of debris.

6. The pick-up head of claim 1, further comprising a suctioning front opening disposed in the front of said housing for receiving debris into said substantially hollow interior of said housing.

7. The pick-up head of claim 6, wherein said suctioning front opening is disposed generally centrally in the front of said housing.

8. The pick-up head of claim 6, further comprising means for urging large debris towards said suctioning front opening.

9. The pick-up head of claim 8, wherein said means for urging debris towards said suctioning front opening comprises a "V"-shaped front wall portion of said housing, wherein said suctioning front opening is disposed at the vertex of said "V"-shaped front wall portion.

10. The pick-up head of claim 6, further comprising a selectively openable and closable door means operatively mounted on said pick-up head for selectively opening and closing said suctioning front opening.

11. The pick-up head of claim 10, wherein said openable and closeable door means comprises at least one door member mounted in hinged relation on said housing.

12. The pick-up head of claim 11, wherein said at least one door member is mounted so as to open inwardly into the substantially hollow interior of said housing.

13. The pick-up head of claim 1, wherein said dust and debris outlet is disposed in the back of said housing.

14. The pick-up head of claim 13, wherein said dust and debris outlet is generally centrally disposed in said back of said housing.

* * * * *